US011608147B1

(12) United States Patent
Shabareck, III et al.

(10) Patent No.: US 11,608,147 B1
(45) Date of Patent: Mar. 21, 2023

(54) MARINE COMMUNICATION SYSTEM AND METHOD OF USE

(71) Applicants: George Michael Shabareck, III, Crowley, TX (US); Erin E Shabareck, Crowley, TX (US)

(72) Inventors: George Michael Shabareck, III, Crowley, TX (US); Erin E Shabareck, Crowley, TX (US)

( * ) Notice: Subject to any disclaimer, the term of this patent is extended or adjusted under 35 U.S.C. 154(b) by 0 days.

(21) Appl. No.: 17/234,694

(22) Filed: Apr. 19, 2021

(51) Int. Cl.
*B63B 45/04* (2006.01)

(52) U.S. Cl.
CPC ..... *B63B 45/04* (2013.01)

(58) Field of Classification Search
CPC ..... B63B 45/04
See application file for complete search history.

(56) References Cited

U.S. PATENT DOCUMENTS 3,109,158 A * 10/1963 Coombs ..... B60Q 1/444 340/464
5,488,361 A 1/1996 Perry
5,636,916 A 6/1997 Sokolowski
6,473,005 B2 10/2002 Showell
6,707,395 B1 * 3/2004 Greiff ..... B63B 45/04 362/477
6,717,525 B1 * 4/2004 Evanoff ..... B63B 45/04 340/815.65
7,794,124 B2 9/2010 Hulsey
8,803,711 B1 * 8/2014 Gonring ..... B63B 45/00 340/987
2002/0172051 A1 * 11/2002 Redding ..... B63B 45/04 362/477
2009/0237949 A1 * 9/2009 Nichols ..... B60Q 1/2657 362/477

* cited by examiner

*Primary Examiner* — Alexander K Garlen

(74) *Attorney, Agent, or Firm* — Leavitt Eldredge Law Firm

(57) ABSTRACT

A marine communication system allows drivers to communicate by the use of lights to indicate their status, direction of motion, or speed. A detector determines the position of the throttle in the boat and sends a signal to a light with a corresponding pattern of emission. One pattern indicates forward motion, another a neutral motion, and yet another a reverse motion.

2 Claims, 4 Drawing Sheets

MARINE COMMUNICATION SYSTEM AND METHOD OF USE

BACKGROUND

1. Field of the Invention

The present invention relates generally to navigation systems and methods, and more specifically, to a marine communication system that broadcasts light signals to indicate an action taken by the operator of a vessel under their command so that various types of actions are clearly communicated to those around them in daylight and in darkness.

2. Description of Related Art

Navigation systems are well known in the art and are effective means to manage the movement of vehicles from one place to another. Common marine navigation devices include buoys, flags, markers, and other visual aids that indicate travel direction and speed to boats in the area to ensure the safe movement of each. A buoy indicates an area where the movement of the boat should not create a wake. Likewise, colored flags or light on the buoy indicate on which side of the buoy that the boat should travel on to proceed in the direction chosen by the operator.

One of the problems commonly associated with common navigation systems is their limited efficiency. For example, when many boats travel in the same area the speed and direction of each must be monitored by the operator of each. The boats then must slow or change direction to ensure safe transit. The operators of the boats can wave or motion to indicate their intentions but with the distance between the boats, these attempts at communication are futile. Without communication from nearby boats, the operators must provide additional space and lower speed to ensure their safety. This creates areas of congestion and waste the time or those on the boats as well as those that operate them.

Accordingly, although great strides have been made in the area of marine navigation systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
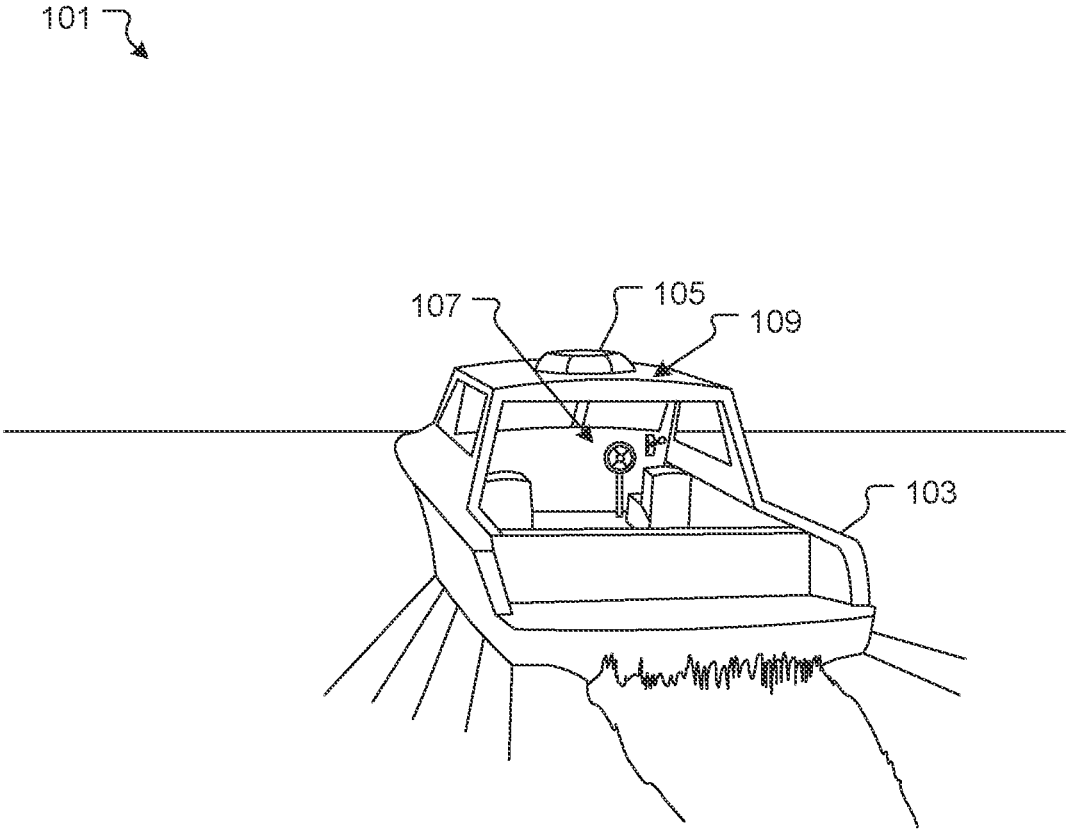
FIG. 1 is a rear view of a marine communication system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with navigation systems. Specifically, the present invention provides a means for an operator of a boat to indicate or signal to other boat operators the actions taken or anticipated to be taken by the boat operator. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a rear view of a marine communication system in accordance with a preferred embodiment of the present application. It will be appreciated that system 101 overcomes one or more of the above-listed problems commonly associated with conventional navigation systems and methods.

In the contemplated embodiment, system 101 includes a marine vessel such as a boat 103 that is operated by a set of controls 107 that include a throttle, a steering wheel, or the like. The boat 103 has a light 105 attached to the top 109 thereof and is configured to direct light in a single direction or multiple directions.

Figure 2:
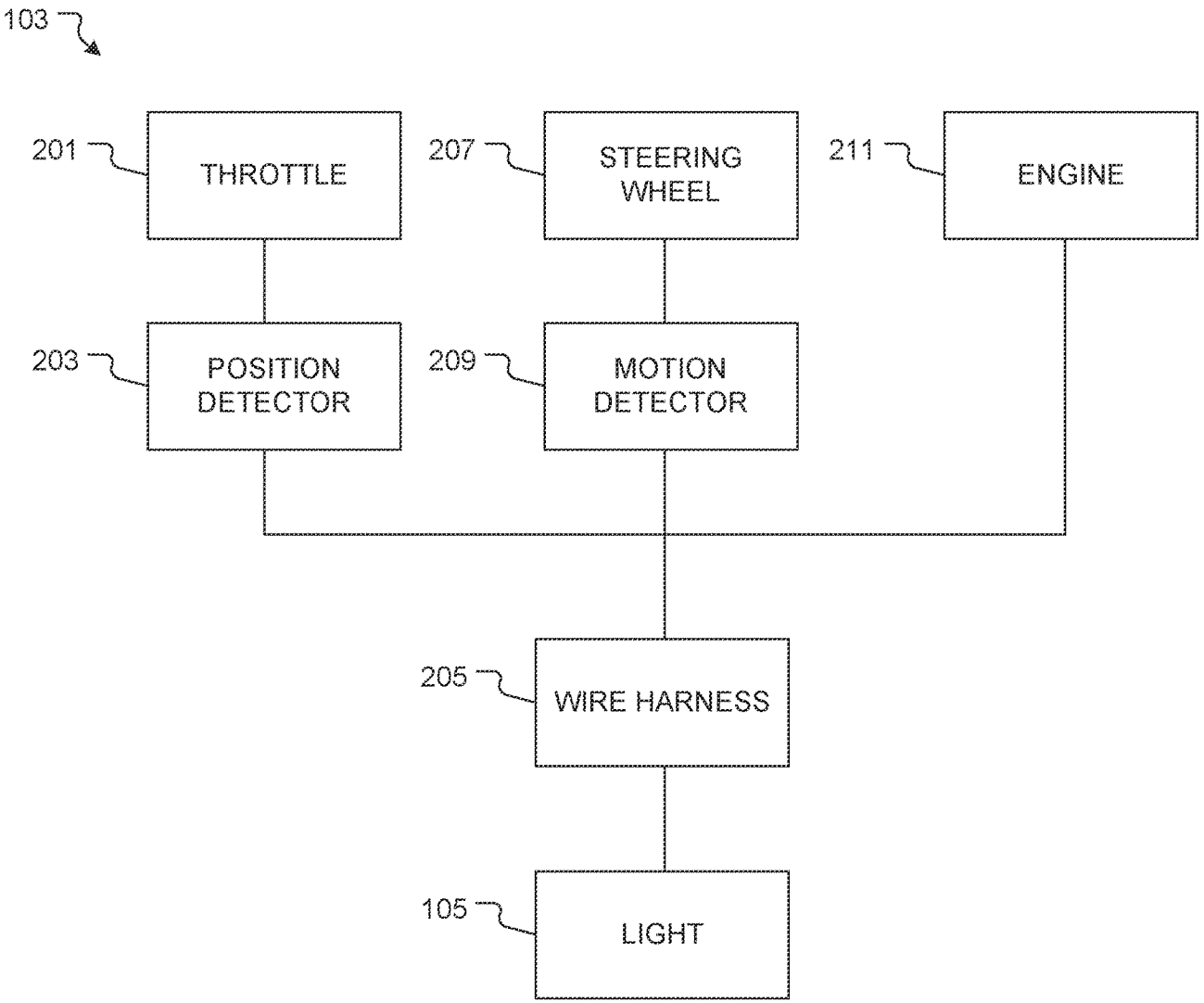
FIG. 2 is a simplified schematic of the controls of FIG. 1.

The system 101 is further depicted by FIG. 2, where a throttle 201 is in communication with a position detector 203 that is in electrical communication with the light 105 via a wire harness 205. The position detector 203 is configured to determine the current selection of the throttle 201 such as in neutral, reverse, or some portion of forward. The steering wheel 207 is in communication with a motion detector 209 that determines the direction that the boat is steered. The motion detector 209 is also in electronic communication with the light 105 via the wire harness 205. It is contemplated that the engine 211 or aspects of it could also be monitored and then transmitted to the light 105 via the wire harness 205.

Figure 3:
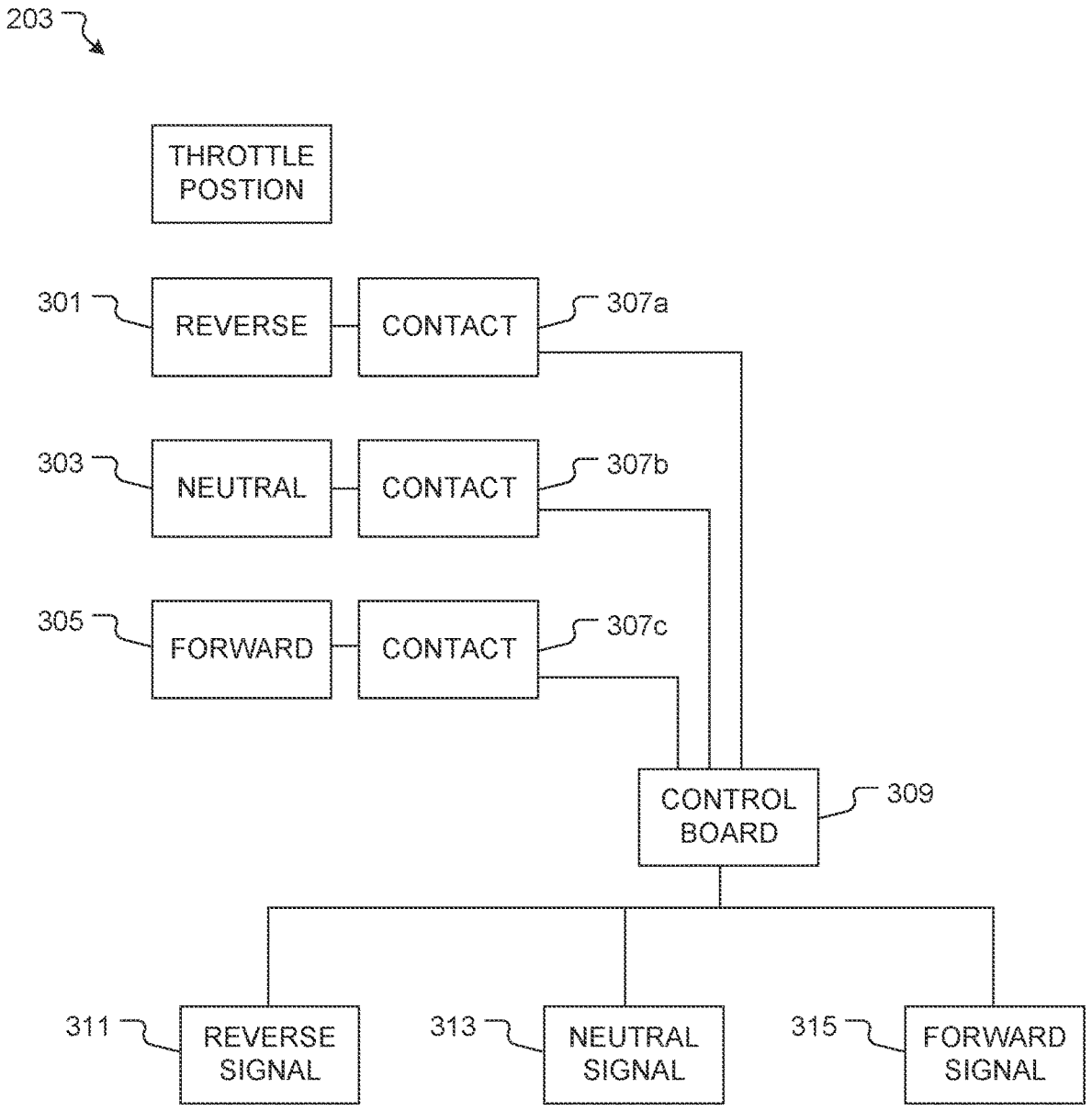
FIG. 3 is a simplified schematic of the position detector of FIG. 2.

The position detector 203 is further depicted by FIG. 3 and includes contacts 307 that detect the presence of the throttle 201 in reverse 301, neutral 303, forward 305, or any other position. The contacts 307 communicate the position to a control board 309 that then sends a signal to the light 105. The control board 309 translates the communication from the contact 307 to a command for the light.

For example, it is contemplated that when the throttle is in reverse 301 the control board 309 will transmit a reverse signal 311 to the light 105 that will cause the light to emit flashes or pulses, when the throttle is in the neutral 303 the control board 309 will transmit a neutral signal 313 to the light 105 that will cause the light to emit a solid red color, and when the throttle is in forward 305 the control board 309 will transmit a forward signal 315 to the light 105 that will turn the light off. Other light colors and patterns are contemplated, and these are given as examples only. Additionally, additional contacts and signals could be used to indicate the amount of energy the motor is producing or other characteristics of the vessel.

In use, the boat 103 transits along a waterway and the light broadcasts to other boat operates the situation of the boat 103. For example, as the boat exits a dock the throttle is placed in reverse, this is detected by the contact 307 and sent to the control board 309 which transmits a reverse signal 311 to the light 105 through the wire harness 205 that then sends light out that is understood to indicate that the boat is in reverse and will or is moving backward. As the boat proceeds and encounters other traffic and must slow and stop the throttle is moved to neutral 303 and the control board 309 transmits the neutral signal 313 to the light 105 to indicate to the other operators that the boat will begin to slow.

It should be appreciated that one of the unique features believed characteristic of the present application is that the position detector 203 captures changes to the throttle 201 and then transmits commands signals to a light that alerts others around the vessel of actions taken by the vessel operator with regards to the motion of the vessel.

Figure 4:
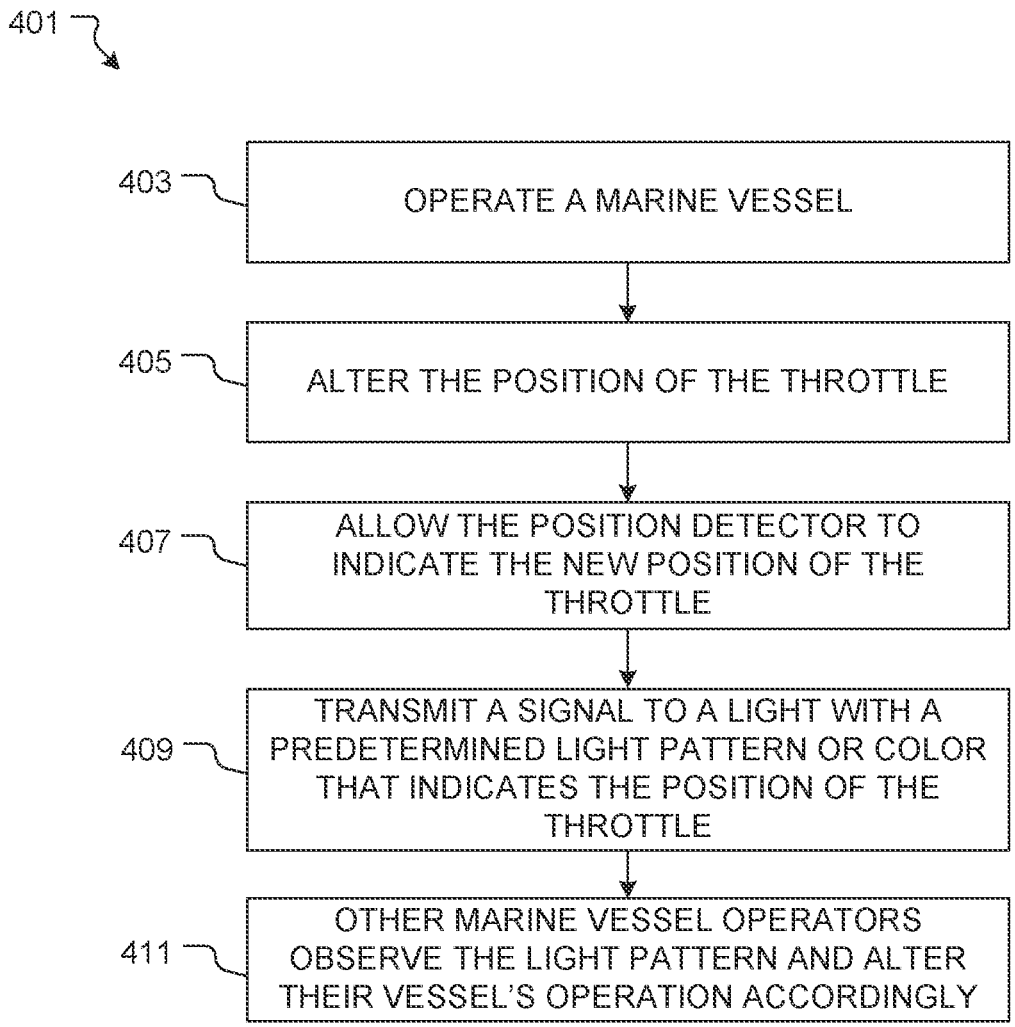
FIG. 4 is a flowchart of a method of communicating between marine vessels.

Referring now to FIG. 4 a method of communicating between a first marine vessel and a second marine vessel is depicted. Method 401 includes operating a marine vessel 403, altering the position of the throttle 405, allowing the position detector to indicate the new position of the throttle 407, transmitting a signal to a light with a predetermined light pattern or color that indicates the position of the throttle 409, other marine vessel operators observing the light pattern and altering their vessels operation accordingly 411.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A marine communication system comprising:

a marine vessel;

at least one light attached to a top of the marine vessel;

a throttle configured to operate with the marine vessel;

at least one position detector in electrical communication with the throttle, the position detector determines when the marine vessel decelerates based on a position of the throttle;

wherein the position detector determines and communicates to the light when the marine vessel decelerates; and wherein the light broadcasts a visual signal to indicate deceleration.

2. The system of claim 1 wherein the position detector is in electronic communication with the light via a wire harness.

* * * * *